United States Patent [19]

Salsness

[11] Patent Number: 4,683,934

[45] Date of Patent: Aug. 4, 1987

[54] GATE LATCH

[76] Inventor: Arthur H. Salsness, 1032 S. Mulberry, Sioux City, Iowa 51106

[21] Appl. No.: 839,378

[22] Filed: Mar. 14, 1986

[51] Int. Cl.[4] ..... A47H 23/00; E06B 3/80

[52] U.S. Cl. ..... 160/328; 16/71; 16/86.1

[58] Field of Search ..... 16/86.1, 86.2, 71; 256/37; 160/328, 329

[56] References Cited

U.S. PATENT DOCUMENTS 887,676 5/1908 Malone ..... 160/328

1,063,151 5/1913 Wiltse ..... 160/328

*Primary Examiner*—Nicholas P. Godici

*Assistant Examiner*—Carmine Cuda

*Attorney, Agent, or Firm*—Zarley, McKee, Thomte Voorhees & Sease

[57] ABSTRACT

A gate latch is described for maintaining a wire gate in a closed position between a pair of gate posts embedded in the ground. The gate latch comprises a support which is nailed to the upper end of one of the gate posts and which has one end of a lever pivotally secured thereto. A U-shaped connector is pivotally secured to the lever and is adapted to be extended over the upper end of the end post member of the gate. The lower end of the end post member is inserted into the U-shaped connector secured to the lower end of the associated gate post. Pivotal movement of the lever causes the upper end of the end post member to be drawn or pulled towards the gate post. When the lever is in its locked position, an "over-center" condition is achieved to maintain the gate in its closed position.

1 Claim, 5 Drawing Figures

GATE LATCH

BACKGROUND OF THE INVENTION

This invention relates to a gate latch and more particularly to a gate latch for closing a post and wire gate.

Conventional wire gates are normally used to close the space between a pair of gate posts which are embedded in the ground. The wire gates are normally comprised of a plurality of wires, usually barbed wires, which are secured at one end to one of the gate posts and which have a post member secured to the other end thereof. When it is desired to close the gate, the lower end of the post member is normally positioned in a wire loop secured to the other gate post. The upper end of the post member is then forced into a position adjacent the gate post so that another loop may be passed over the upper ends of the post member and the gate post. The opening and closing of such gates is extremely difficult since the movement of the post member towards the gate post is resisted by the tension in the gate wires. The opening and closing of the gate is further complicated by the fact that the wires on the gate are normally of the barbed type and the person opening or closing the gate frequently tears his clothing or cuts himself.

It is therefore a principal object of the invention to provide an improved gate latch for a wire gate.

A further object of the invention is to provide an improved gate latch which facilitates the opening and closing of long wire gates.

A further object of the invention is to provide a gate latch which prevents injury to the person opening or closing the gate.

A further object of the invention is to provide a gate latch which prevents the person opening or closing the gate from tearing his clothing.

Still another object of the invention is to provide a gate latch which positively maintains the gate in a closed position.

These and other objects will be apparent to those skilled in the art.

SUMMARY OF THE INVENTION

Figure 1:
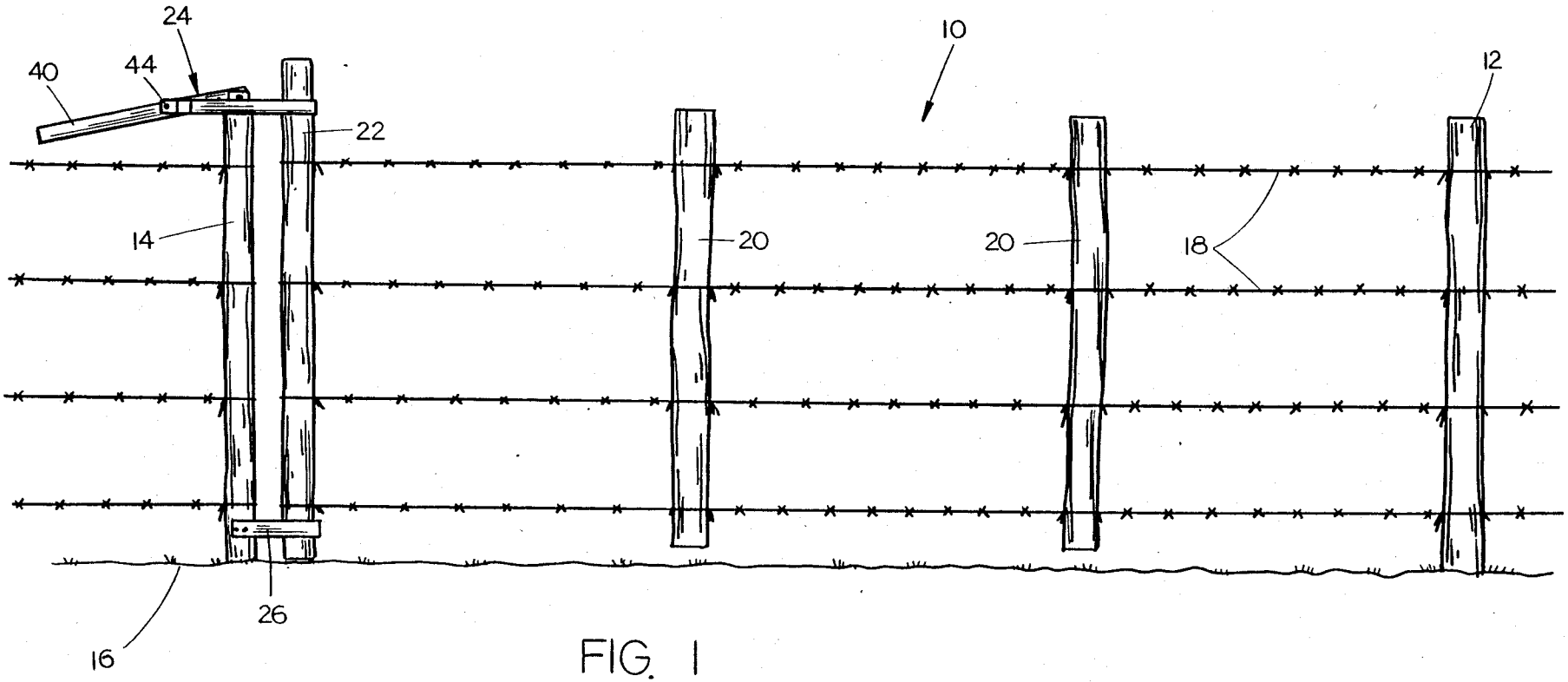
FIG. 1 is a view illustrating the gate latch of this invention being used to maintain a wire gate in a closed position.

A gate latch is described adapted for use in closing a wire gate which extends between a pair of gate posts embedded in the ground. The gate latch of this invention comprises a support plate which is secured to the upper end of one of the gate posts and which has an elongated lever pivotally secured thereto. A U-shaped connector is pivotally secured to the lever and is adapted to be extended over the upper end of the end post member of the gate. The lower end of the post member is inserted into a U-shaped loop member which is secured to the lower end of the gate post. The U-shaped member is positioned over the upper end of the post member and downward pivotal movement of the lever causes the loop member to pull the post member towards the gate post. The lever is pivoted downwardly into an "over-center" position so that the gate will be securely maintained in its closed position.

DESCRIPTION OF THE PREFERRED EMBODIMENT

Referring to the drawings, the numeral 10 refers to a conventional wire gate which is adapted to be extended between a pair of gate posts 12 and 14 which are embedded in the ground 16. Conventional wires usually of the barbed type extend from the gate posts 12 and 14 in conventional fashion.

Gate 10 comprises a plurality of wire members 18 which are secured to gate post 12 and which extend therefrom. Normally, one or more intermediate post members 20 are secured to the wire members 18. An end post member 22 is secured to the "free" ends of the wire members 18 as illustrated in the drawings and normally has a length greater than the intermediate post members 20.

The gate latch of this invention is referred to generally by the reference numeral 24 and is designed to pull the post member 22 towards the gate post 14 and to maintain the post member 22 in the position illustrated in FIG. 1 so that the space between the gate posts 12 and 14 will be closed by the gate 10.

The numeral 26 refers to a lower connection means which is secured to the lower end of gate post 14 which is substantially U-shaped so that it may receive the lower end of the post member 22 as illustrated in the drawings. Although the drawings illustrate the connection means 26 to be of the "strap" type, the connection means 26 could be formed by wrapping wire around the lower end of the gate post 14 wherein a substantially U-shaped member is provided which can receive the lower end of the post member 22.

Figure 5:
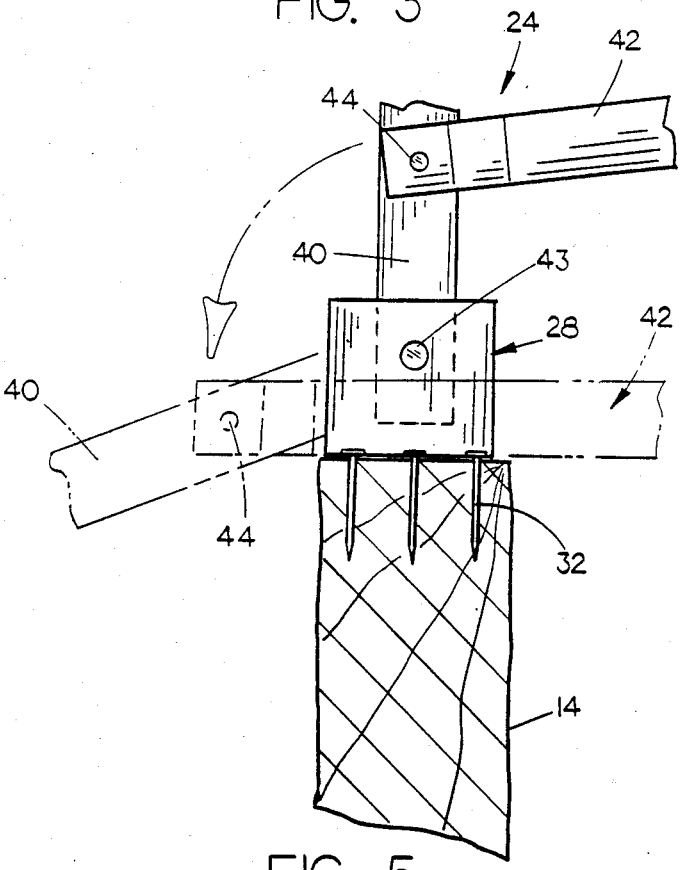
FIG. 5 is a view illustrating the operation of the gate latch with the broken lines illustrating the gate latch in its closed position.

Gate latch 24 comprises a support 28 which is secured to the upper end of the gate post 14 as illustrated in FIG. 5. Support 28 comprises a flat plate 30 which is positioned on the upper end of the gate post 14 and which is secured thereto by a plurality of nails 32 extending downwardly through openings 34 formed in the plate 30. A pair of spaced-apart ears 36 and 38 extend upwardly from plate 30 and have one end of lever 40 pivotally secured thereto by means of pin or bolt 43.

A connection means 42 which is generally U-shaped in configuration is pivotally secured to lever 40 above the lower end thereof by means of bolt or pin 44 as seen in the drawings.

Figure 2:
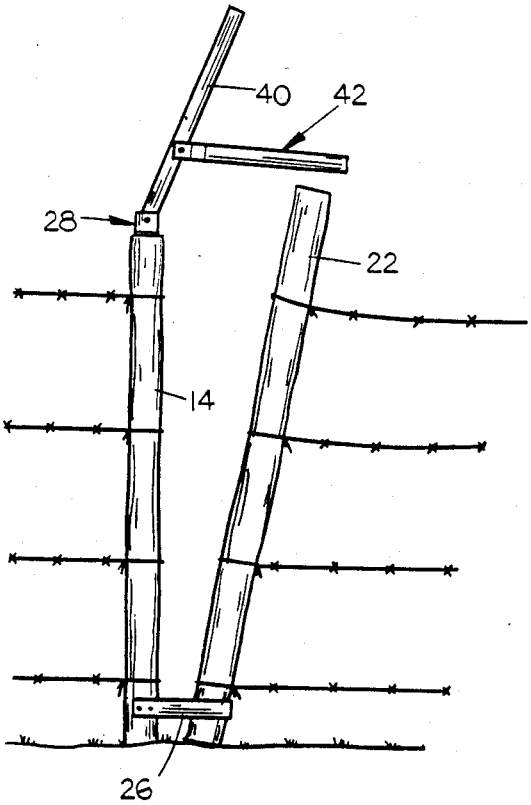
FIG. 2 is a partial view similar to FIG. 1 illustrating the initial position of the relative components.

When it is desired to close the gate 10, the lower end of post member 22 is inserted into the connector 26 as illustrated in FIG. 2. Lever 40 is then pivotally moved in a clockwise direction as viewed in FIG. 2 so that the connector 42 is positioned over the upper end of the post member 22. Connector 42 is then pivotally moved downwardly so that the upper end of the post member 22 is received between the legs 46 and 48 of the connector 42 as illustrated in FIG. 3.

Figure 3:
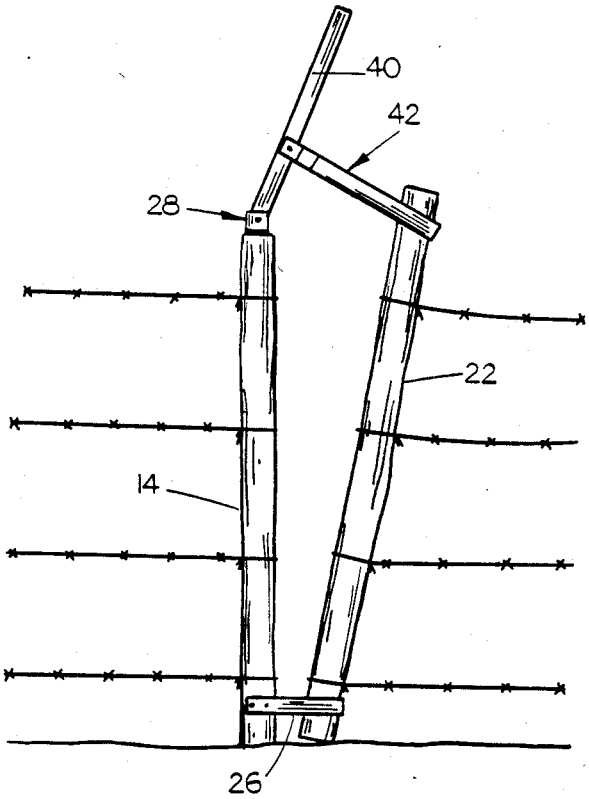
FIG. 3 is a view similar to FIG. 2 illustrating the gate latch being used to close the gate.
Figure 4:
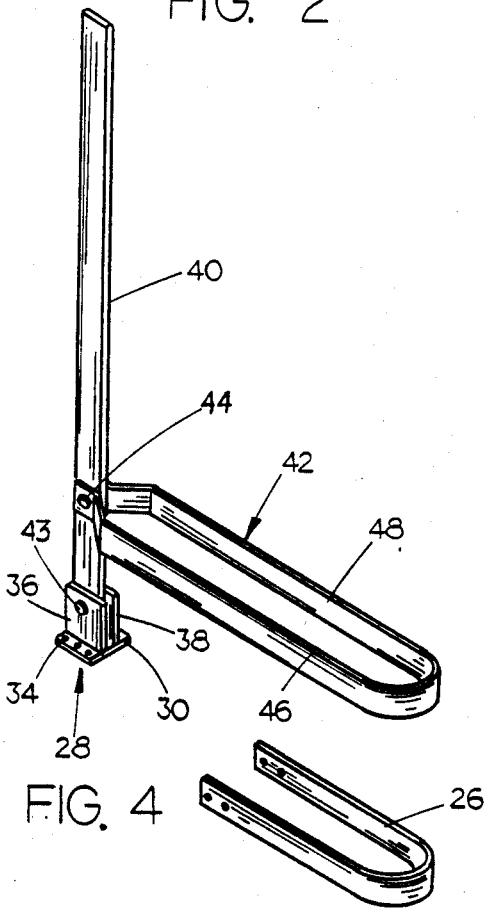
FIG. 4 is a perspective view of the gate latch of this invention.

Lever 40 is then pivotally moved in a counterclockwise direction as viewed in FIG. 3 so that the connector 42 pulls the upper end of post member 22 towards gate post 14. Lever 40 is pivotally moved from the position illustrated by solid lines in FIG. 5 to the position illustrated by broken lines in FIG. 5 which corresponds to the position illustrated in FIG. 1. When lever 40 has been pivotally moved to the position of FIG. 1, the pivotal connection defined by bolt 44 is located below the pivotal connection defined by bolt 43 or "over-center" so that lever 40 is positioned in a locked position to maintain the gate 10 in its closed position.

When it is desired to open the gate, the lever 40 is moved from the position of FIG. 1 upwardly until connector 42 may be disengaged from the upper end of the post member 22. The lower end of post member 22 is then removed from the connector 26 and the gate may be swung into its open position. It can therefore be seen that a novel gate latch has been described which enables a wire gate to be easily opened and closed in a manner so that all of the stated objectives are achieved.

I claim:

1. In combination, first and second vertically disposed and horizontally spaced-apart gate posts, a plurality of substantially horizontally disposed and vertically spaced elongated wire members secured at one end to said first gate post and extending therefrom towards said second gate post, a post member secured to the other ends of said wire members and adapted to be positioned adjacent said second gate post, a first connection means secured to said second gate post adjacent the lower end thereof, adapted to receive the lower end of said post member, said first connection means comprising a substantially U-shaped rigid strap member having parallel legs, the end of each leg being secured to said second gate post and forming a U-shaped loop to receive said post member, a second connection means secured to the top end of said second gate post for connection to the upper end of said post member, and said second connection means comprising:

(a) an upstanding support having a pair of parallel and spaced-apart vertical ears affixed to a horizontal plate, said plate having a plurality of apertures through which nails are inserted to fasten said plate to the top of said second gate post, said plate having dimensions less than the diameter of said gate post, and fastened thereto with no portion of said plate extending beyond the diameter of said gate post, (b) an elongated lever pivotally secured at one end to said ears, said pivotal securement including a pin journaled through an aperture in said lever and corresponding apertures in said ears, the pivotal axis being generally centered on top of said gate post, (c) a U-shaped member comprising a pair of leg members joined by a base portion, said leg members being pivotally secured to said lever adjacent the pivotally connected end of said lever, each leg of said U-shaped member having an end portion parallel to said lever, the U-shaped member being pivotally secured to said lever at said end portions, each leg bent outwardly from each said end portion and then bent parallel to each other and said end portions and extending to join said base portion, (d) wherein said U-shaped member is adapted to be positioned over and around the upper end of said post member so that said lever may be pivotally moved relative to said upstanding support, whereby said post member will be pulled towards said gate post and held in such position, and (e) said U-shaped member being connected to said lever at a point such that pivotal movement of said lever is stopped by the contact of said U-shaped member with said plate, said contact occurring when the pivotal connection of said U-shaped member to said lever is located in a horizontal plane lower than the axis of the pivotal connection of the lever with the upstanding support member, whereby the lever is held in a locked position.

* * * * *